US007427854B2

(12) United States Patent
Redouté et al.

(10) Patent No.: US 7,427,854 B2
(45) Date of Patent: Sep. 23, 2008

(54) DC CURRENT REGULATOR INSENSITIVE TO CONDUCTED EMI

(75) Inventors: Jean-Michel Vladimir Redouté, Heverlee (BE); Michiel Steyaert, Leuven (BE)

(73) Assignee: AMI Semiconductor Belgium BVBA, Oudenaarde (BE)

( * ) Notice: Subject to any disclaimer, the term of this patent is extended or adjusted under 35 U.S.C. 154(b) by 115 days.

(21) Appl. No.: 11/651,514

(22) Filed: Jan. 10, 2007

(65) Prior Publication Data

US 2007/0216484 A1 Sep. 20, 2007

(30) Foreign Application Priority Data

Jan. 10, 2006 (EP) ..... 06447005

(51) Int. Cl.
*G05F 3/26* (2006.01)
*G05F 3/28* (2006.01)

(52) U.S. Cl. ..... 323/316

(58) Field of Classification Search ..... 323/311, 323/312, 315, 316; 327/53, 66, 490
See application file for complete search history.

(56) References Cited

U.S. PATENT DOCUMENTS 4,251,743 A * 2/1981 Hareyama ..... 327/538
4,703,249 A * 10/1987 De La Plaza et al. ..... 323/316
5,381,082 A 1/1995 Schlicht
5,633,612 A * 5/1997 Lee ..... 330/288
6,420,911 B1 7/2002 Warmerdam et al.
7,019,584 B2 * 3/2006 Bartel et al. ..... 327/539

OTHER PUBLICATIONS

P.R. Gray, P.J. Hurst, S.H. Lewis, R.G. Meyer, Analysis and Design of Analogy Integrated Circuits, John Wiley & Sons, Inc., 2001, Ch. 8, pp. 593-599; 637-644.
K.R. Laker, W.M.C. Sansen, Design of Analog Integrated Circuits and Systems, Singapore: Mcgraw-Hill, 1994, ch. 4, pp. 245-407.
R.A.H. Balmford and W. Redman-White, A New High-Compliance CMOS Current Mirror with Low Harmonic Distortion for High Frequency Applications, University of Southhampton, 1994.
E. Alarcon, E. Vidal and A. Poveda, High-Frequency Response Modelling of Continuous-Time Current Mirrors, ECS/IEEE European Conference on Circuit Theory and Design, Aug. 1997, pp. 204-209.
Redoute and Stexaert. "Current Mirror Structure Insensitive to Conducted EMI," *Electronics Letters*, v. 41, No. 21, Oct. 13, 2005, (single page).

* cited by examiner

*Primary Examiner*—Gary L Laxton
(74) *Attorney, Agent, or Firm*—Bacon & Thomas, PLLC

(57) ABSTRACT

A DC current regulator circuit comprises a first circuit node (32) which is operable to receive an external input voltage. A transistor (M1) has an input, a first leg and a second leg. The first leg of the transistor is isolated from the first circuit node (32). An amplifier (10) has an output connected to the input of the transistor (M1), a first amplifier input for receiving a reference voltage ($V_{REF}$) and a second amplifier input connected to the first circuit node (32). A low-pass filter (33) connects between the output of the amplifier and the first circuit node (32). A current mirror (36) connects in series with the second leg of the transistor (M1) and has a first branch (38) for providing a regulated output current and a second branch (37) which connects to the first circuit node (32). The current regulator has reduced sensitivity to conducted EMI received at the first circuit node (32).

20 Claims, 9 Drawing Sheets

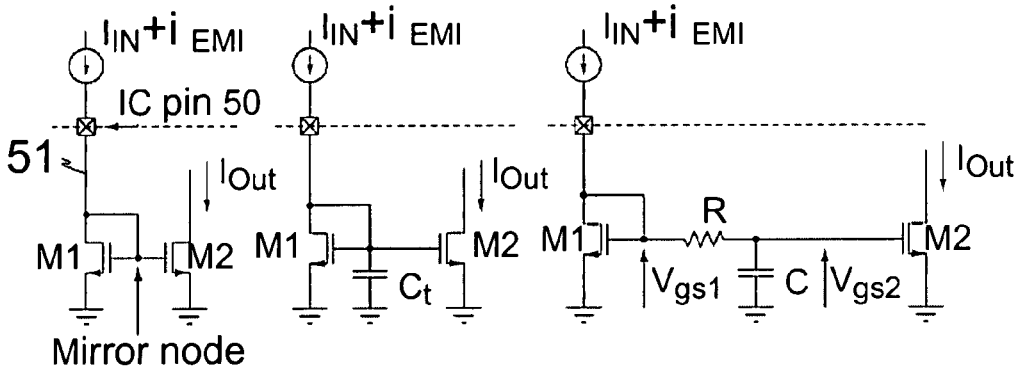
Fig. 10 Fig. 11 Fig. 12
Figure 13
Charge pumping: ordinary mirror with low pass RC
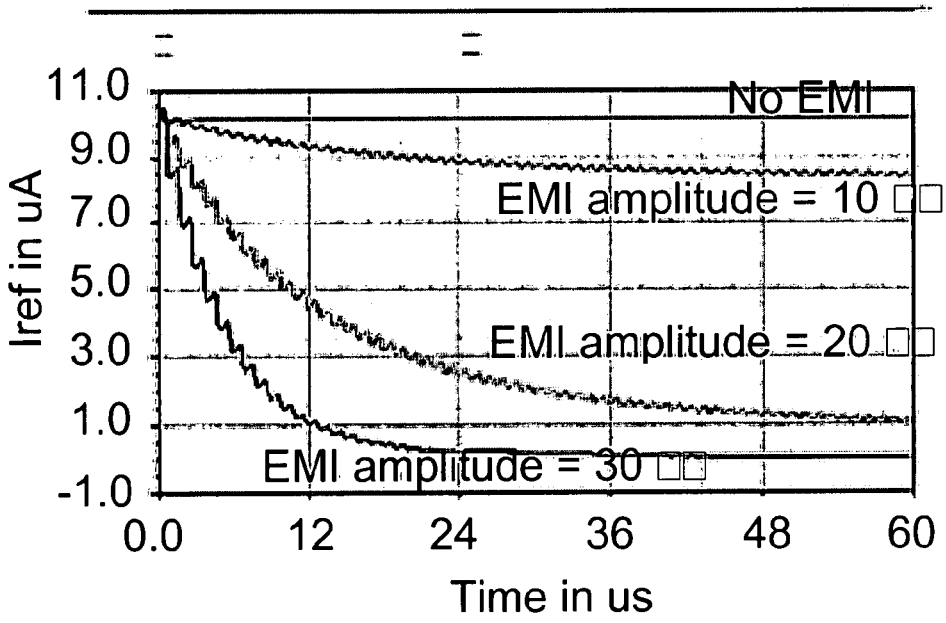

DC CURRENT REGULATOR INSENSITIVE TO CONDUCTED EMI

FIELD OF THE INVENTION

This invention relates to DC current regulators and to current mirrors and to methods of operating the same.

BACKGROUND TO THE INVENTION

The phenomenon of electromagnetic interference (EMI) and the resulting general framework defining to what extent electronic devices and applications must be able to work together without disturbing each other (electromagnetic compatibility, abbreviated EMC) first became a concern during the second World War. One of the top EMI nuisances at that time was the electric motor noise, conducted through power supply lines into sensitive electronic equipment. Since then, the major increase of electronic appliances, the use of higher frequencies and the omnipresence of (fast) switching digital computing devices have made EMC a global concern, that has gained much importance over the years. With appliances working at speeds of a few hundred megahertz, to some gigahertz, even the tiniest track of the most carefully designed printed circuit board (PCB) behaves like a microwave transmission line. In the same way that increasing working frequencies extrapolated the EMI problem from long power lines to much smaller PCB tracks, history is repeating itself by moving this issue towards the field of micro electronic circuits. Due to their small size, microelectronic circuits are in practice not easily disturbed by radiated disturbances, they are however much more prone to noise conducting interferences, that are present on PCB tracks. Current mirrors and current regulators are two commonly used elements in analog circuitry which can be susceptible to conducted EMI.

SUMMARY OF THE INVENTION

Accordingly, an aspect of the present invention seeks to provide a DC current regulator which is affected, to a lesser degree, by conducted EMI. A further aspect of the present invention seeks to provide a current mirror which is affected, to a lesser degree, by conducted EMI.

A first aspect of the present invention provides a current regulator circuit comprising:

a first circuit node which is operable to receive an external input voltage;

a transistor having an input, a first leg and a second leg, the first leg of the transistor being isolated from the first circuit node;

an amplifier having an output connected to the input of the transistor, a first amplifier input for receiving a reference voltage and a second amplifier input connected to the first circuit node;

a low-pass filter connected between the output of the amplifier and the first circuit node;

a current mirror connected in series with the second leg of the transistor and having a first branch for providing a regulated output current and a second branch which connects to the first circuit node.

In this manner, a feedback loop is provided from the first circuit node, the second amplifier input, the output of the amplifier, the input of the transistor, the second leg of the transistor and via the current mirror back to the first circuit node. The loop is subject to the effects of the low-pass filter. The low-pass filter has an advantage of shielding the amplifier and other parts of the circuit from EMI. Isolating the first leg (i.e. the source) of the transistor from the first circuit node, by use of the current mirror, prevents EMI from clipping, and thus distorting, the output current, as occurs in conventional regulators. A further advantage of the improved regulator is that the external EMI source connected to the first circuit node "sees" a high impedance drain (e.g. of an MOS transistor M3 in FIG. 7) instead of a low impedance source, e.g. of an MOS transistor such as M1 in FIG. 1. This also increases the effectiveness of any decoupling capacitor which is connected between the first circuit node and ground. A further advantage is that Ci of the filter can be small, due to the Miller effect of the filter. This makes it advantageous when the circuit is implemented in an integrated circuit, where it is desirable to keep the capacitance as low as possible. A still further advantage is that EMI disturbance is filtered before it reaches the input of the amplifier. A DC shift at the output of the amplifier due to EMI injection at its input is avoided because the signal at the input to the opamp is already filtered by the filter.

Preferably, in the circuit the first branch is directly or indirectly coupled to an output stage, which comprises a further current mirror, wherein the further current mirror is an EMI-filtering current mirror.

This provides the advantage that the output is smoothed still further with respect to EMI frequencies.

A regulated output current can be taken directly from the second leg (drain) of the transistor. In this embodiment, the first branch of the current mirror is in series with the second leg (drain) of the transistor. In an alternative, and preferred, arrangement the first branch of the current mirror which provides the regulated output current is a mirrored branch. This allows the current flowing from the second leg of the transistor to be copied and scaled, as required. In a further alternative embodiment the first mirrored branch connects to an output stage comprising one or more current mirrors which each provide a degree of EMI-filtering.

The amplifier is preferably an operational amplifier (opamp).

A further aspect of the present invention provides a current regulator circuit comprising:

a first circuit node which is operable to receive an external input voltage;

a transistor having an input, a first leg and a second leg, the first leg of the transistor being connected to the first circuit node;

an amplifier (10) having an output connected to the input of the transistor, a first amplifier input for receiving a reference voltage ($V_{REF}$) and a second amplifier input connected to the first circuit node;

a low-pass filter connected between the output of the amplifier and the first circuit node; and, a current mirror connected in series with the second leg of the transistor, wherein the current mirror comprises a second transistor and a third transistor whose gates are connected together at a mirror node, the third transistor having an input branch connected in series with the second leg of the transistor to receive current and the third transistor having an output branch to mirror the received current as an output current ($I_{ref}$);

a fourth transistor connected between the mirror node and a supply rail (Vcc); and, a fifth transistor connected between the mirror node and another supply rail and having an input connected to the input branch.

The current mirror connected in series with the second leg of the transistor provides an EMI-filtering function.

Although the specific embodiments described in this specification show MOS transistors, it will be appreciated that any other type of transistor can be used in the circuits of the present invention, such as bipolar junction transistors (BJT).

BRIEF DESCRIPTION OF THE DRAWINGS

Embodiments of the invention will be described, by way of example only, with reference to the accompanying drawings in which:

FIG. 10 shows a conventional current mirror;

FIG. 11 shows a current mirror with a capacitor added between gate and ground;

FIG. 12 shows a current mirror with a low-pass RC filter between the gates;

FIG. 13 shows the effect of charge pumping on the output current of the ordinary current mirror with a low-pass RC filter between the gates;

DESCRIPTION OF PREFERRED EMBODIMENTS

Figure 1:
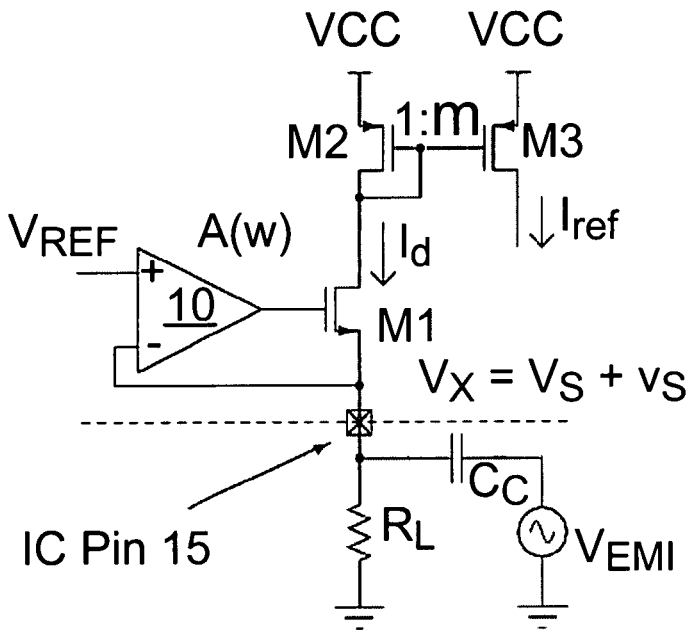
FIG. 1 shows a schematic of a trimmed current regulator which includes a current mirror.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. Where the term "comprising" is used in the present description and claims, it does not exclude other elements or steps. Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

FIG. 1 shows a current regulator which is based on the well-studied series voltage regulator, using a series-shunt feedback configuration of an amplifier such as an op-amp 10 and transistor M1 as described, for example, by P. R. Gray, P. J. Hurst, S. H. Lewis, R. G. Meyer, *Analysis and Design of Analog Integrated Circuits*. John Wiley & Sons, inc., 2001, ch. 8, pp 593-599 and pp. 637-644. The purpose of this circuit is to generate a constant DC current. The value of the generated current is determined by an external trimming resistance $R_L$, which is connected to pin 15 of the integrated circuit package, and an internally generated fixed voltage $V_{REF}$. A current mirror comprising transistors M2, M3 copies and scales the generated current Id to provide an output current Iref for use internally on the chip. A scaling factor 1:m is shown but any convenient factor can be used. In this way, a very precise and trimmable reference current is obtained.

Suppose conducted EMI (Vemi) is injected into this circuit at the trim pin 15, through a coupling capacitance Cc (FIG. 1). Strictly speaking, capacitor Cc is not a physical component, and it has no well-defined value: its sole purpose is to simulate the coupling of an EMI disturbance into the circuit. Assuming that the op-amp 10 behaves like a perfect one pole system, its transfer function can be expressed as:

$$A(s) = \frac{A_{DC}}{1 + (s/p1)}, \tag{1}$$

where p1 is the non-zero, finite dominant pole of A(s).

As long as Vemi is a small amplitude signal, so that the output MOS transistor remains in saturation, the voltage Vx at the source of transistor M1 can be written as the sum of a DC term VS, and an AC term vs:

$$V_x = V_S + v_s. \tag{2}$$

Using the expression for a MOS transistor in saturation, the calculation for current Id yields:

$$I_d = \frac{\mu C_{ox}}{2}\frac{W}{L}(V_{GS} - V_t)^2 - \mu C_{ox}\frac{W}{L}(V_{GS} - V_t)(A(s) + 1)v_s + \frac{\mu C_{ox}}{2}\frac{W}{L}(A(s) + 1)^2 v_s^2, \tag{3}$$

where:

$$V_{GS} = A_{DC}V_{ref} - (A_{DC} + 1)V_S. \tag{4}$$

If no op-amp 10 is present, then $V_{REF}$ is directly connected to the gate of transistor M1, and so in that case, Id is equal to:

$$I_d = \frac{\mu C_{ox}}{2}\frac{W}{L}(V_{GS} - V_t)^2 - \mu C_{ox}\frac{W}{L}(V_{GS} - V_t)v_s + \frac{\mu C_{ox}}{2}\frac{W}{L}v_s^2, \tag{5}$$

where:

$$V_{GS} = V_{REF} - V_S. \tag{6}$$

In equations (3) and (5) three different terms are clearly recognized, namely a DC term, a linear AC term and a quadratic AC term. These terms will be referred to as respectively the $1^{st}$, the $2^{nd}$ and the $3^{rd}$ term in the following explanation. Let gm be the transconductance of transistor M1. Assuming that 1/gm<<RL, the transfer function from Vemi to the source of M1 is easily found. Substituting these expressions into (3) and (5) yields the following results; in case where the op-amp is present:

$$I_d = \frac{\mu C_{ox}}{2}\frac{W}{L}(V_{GS}-V_t)^2 - \mu C_{ox}\frac{W}{L}(V_{GS}-V_t)(A(s)+1)\left(\frac{\left(\frac{C_c}{gm\cdot p1}\right)s^2+\left(\frac{C_c}{gm}\right)s}{\left(\frac{C_c}{gm\cdot p1}\right)s^2+\left(\frac{1}{p1}+\frac{C_c}{gm}\right)s+1+A_{DC}}V_{emi}\right)+\frac{\mu C_{ox}}{2}\frac{W}{L}(A(s)+1)^2\left(\frac{\left(\frac{C_c}{gm.p1}\right)s^2+\left(\frac{C_c}{gm}\right)s}{\left(\frac{C_c}{gm\cdot p1}\right)s^2+\left(\frac{1}{p1}+\frac{C_c}{gm}\right)s+1+A_{DC}}V_{emi}\right)^2, \quad (7)$$

and in the case where no op-amp is present:

$$I_d = \frac{\mu C_{ox}}{2}\frac{W}{L}(V_{GS}-V_t)^2 - \mu C_{ox}\frac{W}{L}(V_{GS}-V_t)\left(\frac{\left(\frac{C_c}{gm}\right)s}{\left(\frac{C_c}{gm}\right)s+1}V_{emi}\right)+\frac{\mu C_{ox}}{2}\frac{W}{L}\left(\frac{\left(\frac{C_c}{gm}\right)s}{\left(\frac{C_c}{gm}\right)s+1}V_{emi}\right)^2. \quad (8)$$

Figure 5:
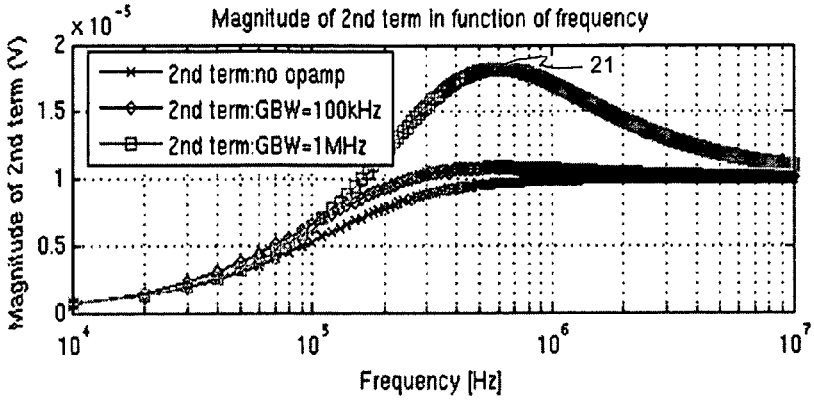
FIGS. 5 and 6 shows performance related features of the regulator of FIG. 1 with respect to frequency, these firgures show the magnitudes of the $2^{nd}$ and 3rd order distortion terms with respect to frequency, which are related to performance.

The DC gain of the op-amp 10 depends on the tolerated DC error. Nevertheless, its pole location (and the resulting gain bandwidth (GBW) product) is a factor still to be determined. FIG. 5 shows a plot of the magnitude of the $2^{nd}$ and the $3^{rd}$ term of Id as a function of the frequency, for a gm=1 mS, Cc=1 nF, VGS−Vt=100 mV, and with a Vemi magnitude of 10 mV RMS. This has serious implications which will be described below.

Figure 2:
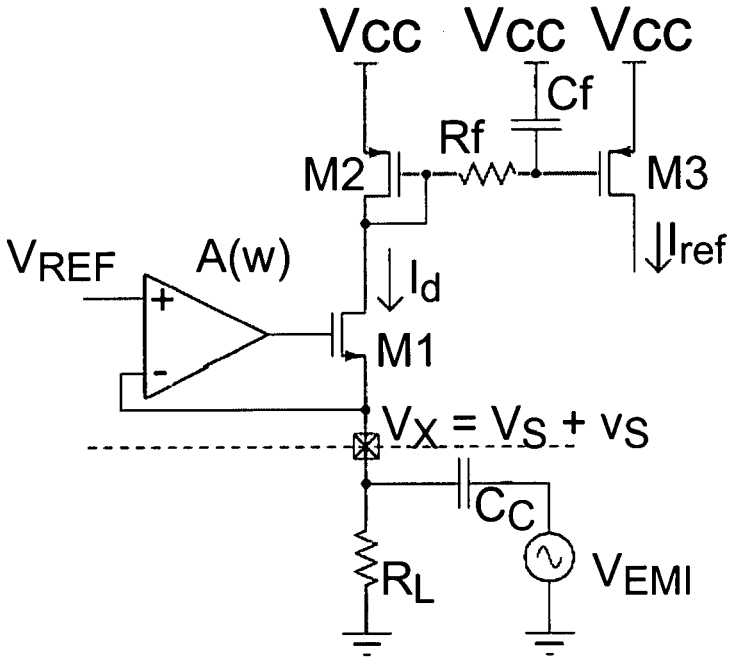
FIG. 2 shows the regulator of FIG. 1 with the addition of a low-pass filter in the mirror node.

Iref must ideally be equal to the wanted DC reference current, with preferably no AC components due to the EMI source at all, or at least limited to a ripple that is as small as possible. Externally, a decoupling capacitor can be placed to filter EMI: however, for the sake of the argument, let's assume that since an EMI problem is present in this circuit, this decoupling capacitor is either absent, or simply ineffective at the respective EMI frequencies. A possibility to filter EMI is to include a RC low-pass filter in the mirror node, as indicated in FIG. 2. By doing so however, there is a risk of charge pumping occurring on the mirror node. The non-linear components of Vgs2 will be linearly filtered by the RfCf low-pass filter, causing a decrease of the DC value of Vgs3, thereby completely distorting the wanted output DC current. This is described more fully later in this specification. This effect is called charge pumping, because due to the linear filtering of a non-linear signal, the voltage across capacitor Cf is 'pumped' to a lower value than it should originally have been, without the presence of EMI. This effect will be demonstrated here. Let the current Id be the sum of a wanted DC current and a linear AC term due to the EMI. Introducing the modulation index m representing the ratio between the disturbance amplitude and the bias current, the current Id can be written as:

$$I_d = I_D + \hat{i}\sin(\omega t) = I_D + mI_D\sin(\omega t). \quad (9)$$

As long as m<1, Taylor expansion can be used. Vgs2 can then be expressed in terms of ID, as follows:

$$V_{gs2} = V_t + \sqrt{\frac{I_D}{\frac{\mu C_{ox}}{2}\frac{W_2}{L_2}}}\sqrt{1+m\cdot\sin(\omega t)} \quad (10)$$

-continued $$= V_t + \sqrt{\frac{I_D}{\frac{\mu C_{ox}}{2}\frac{W_2}{L_2}}}\left(1+\frac{1}{2}(m\cdot\sin(\omega t))-\ldots\right).$$

Considering that the EMI frequency co lies well above the cut off frequency of the low-pass filter formed by Rf and Cf:

$$V_{gs3} \approx \langle V_{gs2}\rangle = V_{GS2} = \frac{1}{T}\int_0^T V_{gs2}\cdot dt = V_t + \sqrt{\frac{I_{IN}}{\frac{\mu C_{ox}}{2}\frac{W_2}{L_2}}}\left(1-\frac{1}{16}m^2-\frac{15}{512}m^4-\ldots\right). \quad (11)$$

This yields a different DC value compared to the case when no EMI was present. Returning to the current regulating circuit, it will now be shown that the RC low-pass filter in the mirror node does not cause charge pumping in case the op-amp is not present in the circuit. Referring to equation (5), the resulting VGS2 can be easily found:

$$V_{GS2} = \sqrt{\frac{I_d}{\frac{\mu C_{ox}}{2}\frac{W_2}{L_2}}} + V_t = (V_{REF}-V_S-V_t)\sqrt{\frac{W_1}{L_1}\frac{L_2}{W_2}} + V_t - v_s\sqrt{\frac{W_1}{L_1}\frac{L_2}{W_2}}. \quad (12)$$

Figure 3:
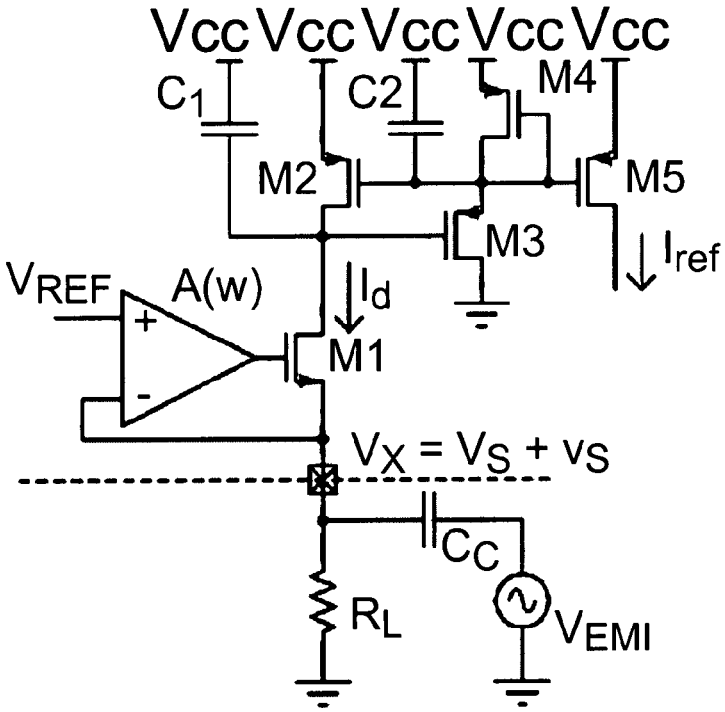
FIG. 3 shows the regulator of FIG. 2 with an EMI insensitive current mirror.
Figure 6:
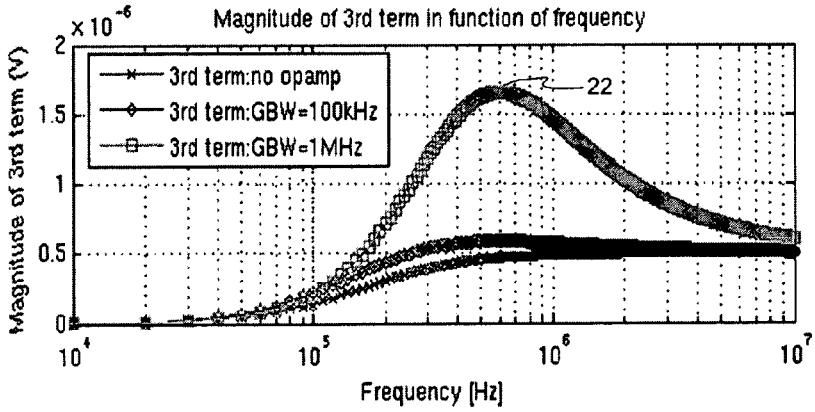

This previous expansion clearly shows the gate-source voltage of the first mirror transistor (Vgs2) contains a constant DC term, and a linear AC voltage. Since this is a perfectly linear voltage signal, charge pumping will not occur as long as the AC components in Id stay small. Considering the case when the op-amp is present, a similar calculation can be performed. However, FIGS. 5 and 6 show that for GBW values that are higher than the lowest EMI frequencies, a peaking 21, 22 takes place in the frequency response of the linear and quadratic AC terms. This means that the AC terms are much larger in this certain frequency range and in that case it is, strictly speaking, no longer correct to express Id as a perfect quadratic equation of the type (3) since higher-order power terms can no longer be dismissed. The totality of these non-linearities in turn induces charge pumping. A possible solution is to use a current mirror structure that is able to filter EMI without causing charge pumping as shown in FIG. 3. However, the AC peaking is still present.

FIGS. 5 and 6 show that the higher the gain-bandwidth product GBW of the op-amp, the larger the magnitude of the $2^{nd}$ and $3^{rd}$ term of equation (7) become. This conclusion can also be obtained mathematically from equations (7) and (8). If $$GBW = p1\cdot A_{DC} \ll \frac{gm}{C_c}, \quad (13)$$

then (7) simplifies to (8), in other words the op-amp becomes transparent to EMI frequencies. This seems at first an incorrect conclusion, since it has been certified earlier that Cc is a fictitious capacitor, representing a certain existing coupling of Vemi into the circuit. Additionally, and making abstraction of its exact nature, this coupling forms a high-pass filter with the input impedance of the circuit, and defines at which frequency the EMI starts to disturb the circuit under study: without the op-amp and disregarding the loading resistance RL, this pole frequency is equal to the ratio gm/Cc in the practical case when the coupling is represented by a capacitor. Adding an op-amp moves this pole a factor (1+A(s)) to higher frequencies, since the input impedance at the source is no longer 1/gm but 1/(gm(1+A(s)) instead. However, due to the op-amp, the signal at the source of M1 is equally amplified and inverted by the op-amp and fed back to the gate of M1. This causes the gate-source voltage of M1 to contain high swings, depending on the gain of the op-amp. These high Vgs1 swings generate, in turn, a highly modulated current Id, containing more AC components than in the event that the op-amp is not present (clearly visible in FIGS. 5 and 6). This constraint translates into the mathematical requirement (13), which at first sight seems absurd due to the non existence of Cc. However, formulated differently in the way it has been done here above, the reasoning behind this formula makes perfect sense, namely that the GBW of the op-amp must be lower than the lowest EMI frequencies. These interfering frequencies can be as low as 150 kHz, and this poses a serious constraint on the op-amp GBW. By means of the Miller capacitance Ci, the dominant pole of the op-amp is lowered due to pole splitting. Adding resistor Ri in the feedback loop forms a classical integrator, and completes the circuit.

Figure 4:
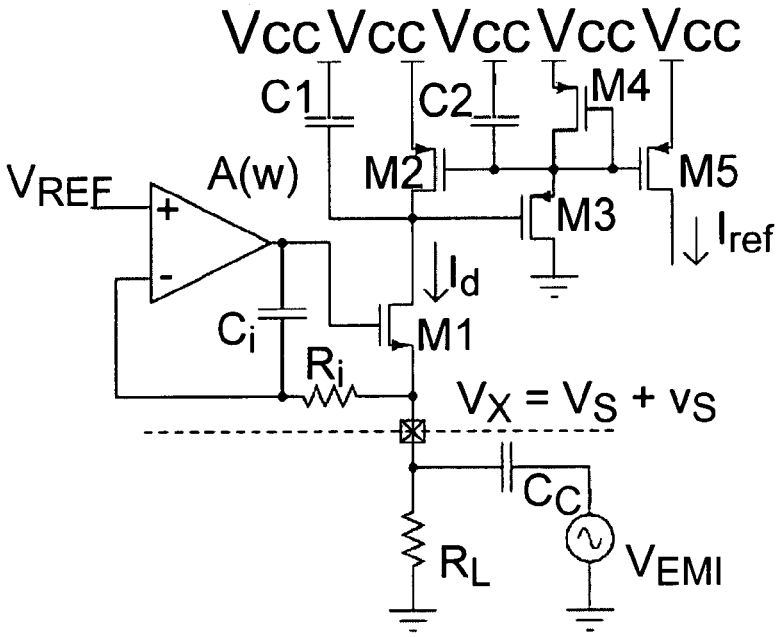
FIG. 4 shows the regulator of FIG. 3 with the addition of an integrator to reduce the gain bandwidth product (GBW)

Simulations of FIG. 4 give good results as long as the amplitude of the disturbance source stays low. However, as the amplitude of the EMI source becomes larger, transistor M1 starts to clip the positive amplitude variations, thereby introducing severe non-linear components in the expression for current Id. A portion of these components propagate to the output reference current Iref, causing a distorted reference current. This issue will be addressed in detail in the following section.

Figure 7:
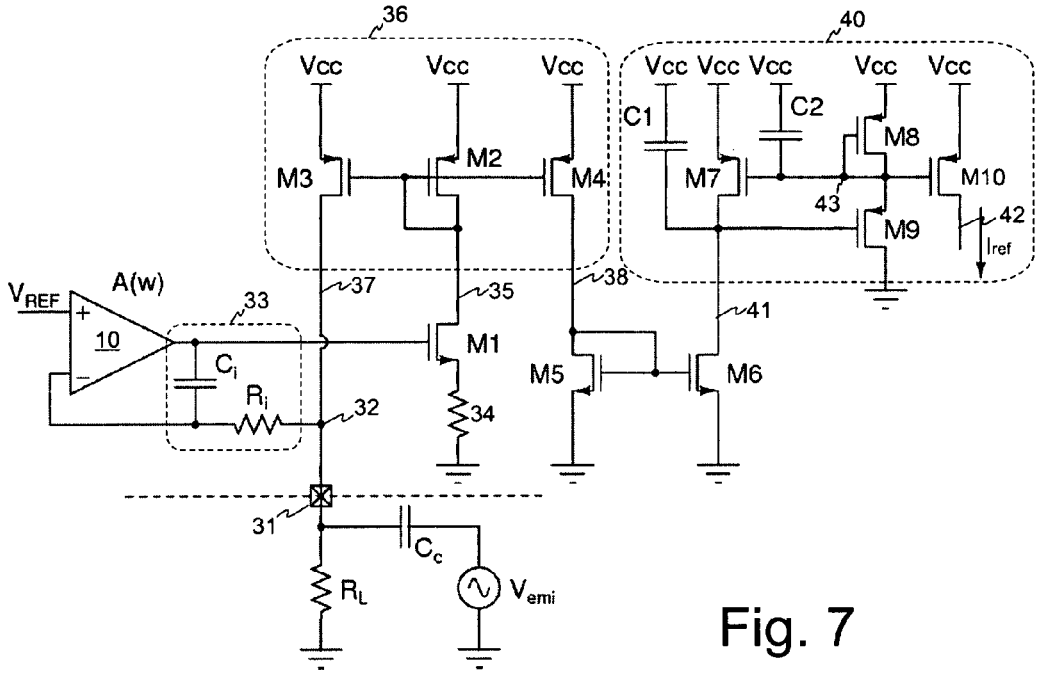
FIG. 7 shows a regulator in accordance with an embodiment of the present invention.

It has been found that the main weakness of the classic current regulating structure is that the EMI source interferes with the source as well as the gate of transistor M1. Although it is possible to make the feedback path through the op-amp inaccessible to EMI by lowering the bandwidth of the op-amp it is, in the classic structure, not possible to reduce the EMI voltage at the source of the regulating transistor M1. This results in clipping and consequent heavy non-linear effects, which are dependent on the EMI amplitude. These problems can be solved by routing the feedback loop in a different way, as shown in FIG. 7. As before, FIG. 7 shows a regulator implemented as an integrated circuit having a pin 31 for connection to external resistor $R_L$. The resistor $R_L$ can either have a fixed value, or preferably is a variable resistance which can be set ('trimmed') to a particular value to determine the output current that is to be generated by the regulator. In the arrangement of FIG. 7 it can be seen that the source of transistor M1 does not connect to pin 31. Stated another way, the source of transistor M1 is now isolated from the input pin 31 where conducted EMI can enter the circuit. The source resistance 34 self-biases this stage and reduces its gain, so that the remaining EMI fluctuations at the gate of M1 do not drag it out of its operating region (and, by doing so, causing a pulsed drain current). The term "self biasing" refers to the use of a simple source resistance 34 which ensures that the DC bias of the MOS transistor M1 is fulfilled. This source resistance also linearises the transconductance (gm) of that MOS transistor. If this source resistance were not present and if the EMI disturbance at the output of the opamp is too large, the transistor M1 will be clipped, creating a pulsed drain current. Adding a source resistance not only sets the DC level on the gate of M1 to a "better" value (e.g. at half the supply voltage, therefore adding more "margin" before clipping takes place), but it also will function as a negative feedback component, linearising gm. For example, if the gate voltage rises, drain current increases, source voltage increases which means that $V_{GS}$ decreases and the drain current decreases. This means that the gain gm is linearized. Use of this source resistor is optional. It is not mandatory for the basic operation of the present invention.

A current mirror 36 copies the current generated in leg 35, and completes a feedback loop to node 32, while making another copy to generate the wanted DC current. The current mirror comprises a first transistor M2 connected in series with the drain of transistor M1. The drain of transistor M2 is connected to the gate of transistor M2. The gate of transistor M2 is connected to the gate of each of transistors M3 and M4. The current flowing in leg 35 is mirrored in each of branches 37, 38. Branch 37 connects to node 32 and connects to the inverting input of amplifier 10. A feedback loop is provided between node 32, the inverting input (−) of amplifier 10, the gate of transistor M1, leg 35, via current mirror 36, branch 37 of the current mirror 36 back to node 32.

An integrator 33 is connected between node 32 and the output of amplifier 10. The integrator comprises a capacitance Ci connected between the output and inverting input of the amplifier 10, and a resistance Ri connected in series with the inverting input. Integrator 33 has the effect of filtering the input, and thus limiting the GBW of the amplifier.

Various modifications are included within the scope of the present invention. For example, a different low-pass filter could be used, instead of the integrator. However, by using the integrator, Ci can be much smaller due to Miller effect which is one of the main advantages provided by integration.

It is preferable to reduce, as much as possible, the disturbance component on the inverting input of the amplifier as this is this signal that will cause charge pumping (=DC shift) on the amplifier output. Increasing Ci decreases the integrator cut-off frequency, but equally causes the positive zero (inherent in the Miller capacitor Ci) to decrease in frequency. Therefore, it is preferable to increase the value of Ri, which maintains the position of the positive zero and the lowers (in frequency) the position of the integrator pole. Preferably, the GBW of the integrator should be as small as possible, e.g. loop must work for DC as well. However, this could make a very slow loop, with a very long settling time. On the other hand, a GBW that is too high means that more EMI is able to "leak" into the circuit. It is preferable that the GBW is several orders of magnitude lower than the lowest EMI frequency.

Figure 14:
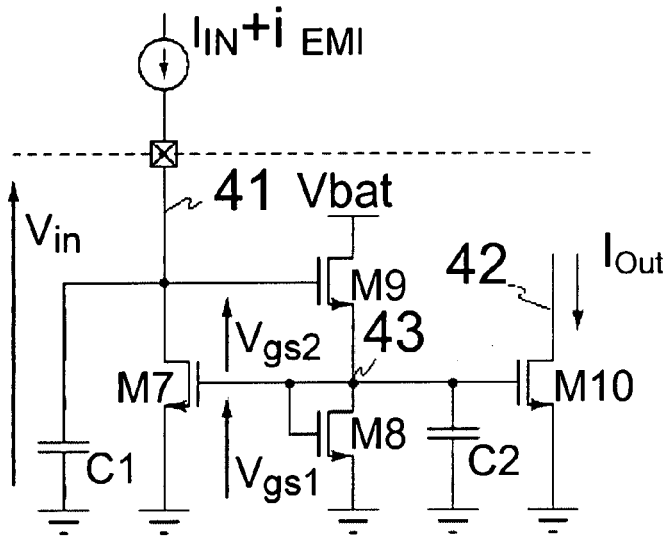
FIG. 14 shows an improved current mirror which is able to filter and to withstand EMI applied on its input, with a high degree of insensitivity against charge pumping.

FIG. 7 shows one preferred topology for the output stage of the regulator. The invention is not limited to the form shown in FIG. 7. In a simplified form, the regulated output current can be taken directly from the drain of transistor M1. Transistors M2 and M3 still need to be present to form the current mirror which completes the feedback loop to node 32. Providing the additional transistor M4 in current mirror 36 allows the drain current flowing in leg 35 to be scaled to an appropriate value needed elsewhere on the integrated circuit. The scaling can be achieved, for example, by appropriate dimensions of the devices M2, M4 or by other known methods. As a further alternative, the current in branch 38 could be used directly as a regulated output current. In FIG. 7 transistors M5 and M6 form a further current mirror which receives the current in branch 38 and mirrors this as an output current in branch 41. A further current mirror is shown generally as an output stage 40. A current received on branch 41 is mirrored, via transistors M7, M10, to an output branch 42 to provide a regulated output current Iref. Transistors M8, M9 have an EMI-filtering effect on the current mirror. Output stage 40 operates as an EMI-filtering current mirror and the operation of this stage, and the theory behind the operation, is given in more detail below. FIG. 14 and the accompanying text, in particular, describes an improved current mirror shown as output stage 40 in FIG. 7 as an embodiment of the present invention. Transistors M5, M6 could be omitted or could take the form of a further EMI-filtering current mirror of the type shown as output stage 40.

Figure 8:
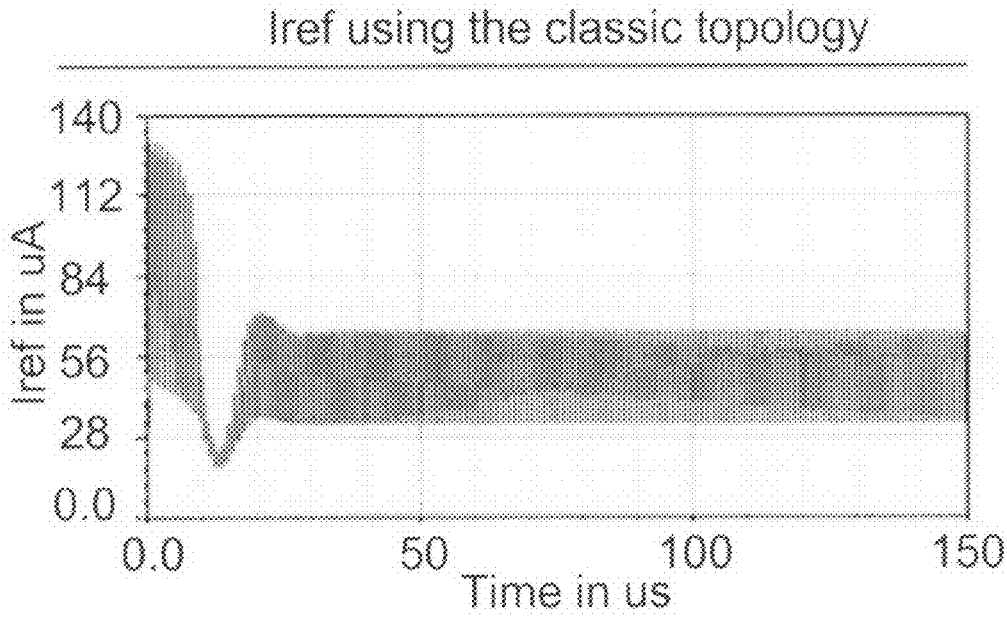
FIGS. 8 and 9 compare performance of the regulators of FIGS. 4 and 7
Figure 9:
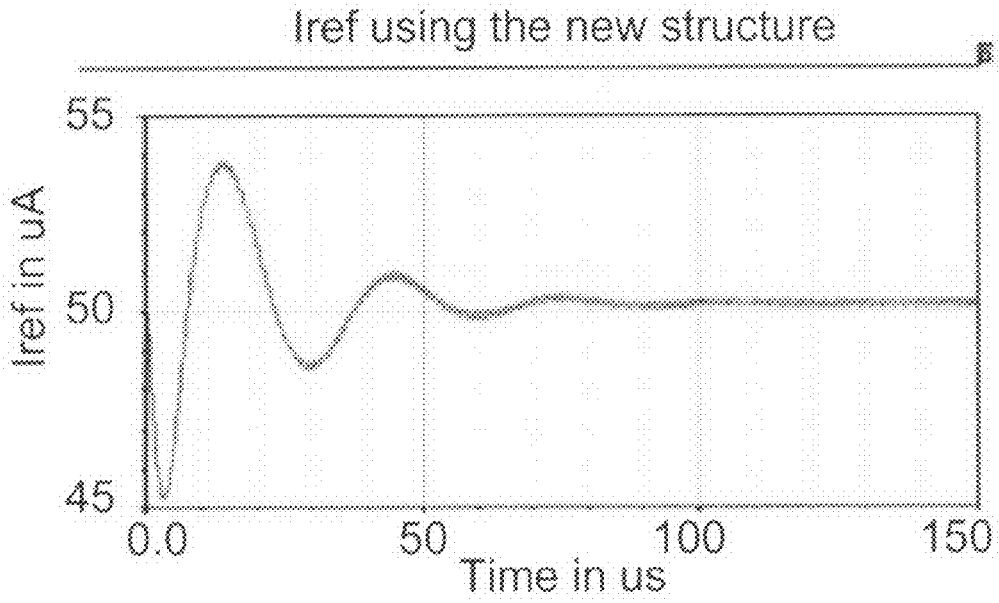

The performance of the circuit topologies shown in FIG. 4 and FIG. 7 are compared in the graphs of FIGS. 8 and 9. These are based on simulations with $V_{REF}$=0.5V, and $R_L$=5 kΩ, to accommodate a bias current of 50 μA. The op-amp 10 is a standard one pole op-amp with a GBW=10 MHz and a DC gain of 60 dB. Ri and Ci are respectively 200 k and 10 pF, which are perfectly integrable values. In both cases, capacitors C1 and C2 were chosen according to a Butterworth filter synthesis as described in the above-mentioned paper. Their total capacitance value equals 53 pF. The EMI source has an amplitude of 1V at a frequency of 1 MHz, and couples in the circuit via a coupling capacitor Cc of value 1 nF. FIGS. 8 and 9 show plots of Iref against time. It should be noted that the classic regulator structure gives a distorted Iref (FIG. 8 based on the circuit of FIG. 4), whereas the new structure produces a clean Iref signal with only a small AC ripple, independent of the high EMI amplitude (FIG. 9 based on the circuit of FIG. 7). The difference in results shows the effect of the EMI-filtering current mirror of the type shown as output stage 40.

Accordingly, a further aspect of the invention is a current mirror topology which is less sensitive to EMI. This will now be described more fully. The intrinsic non-linearity of analog integrated devices and circuits is a common source of EMI problems. These problems are likely to occur when a disturbance source is generating signal components at frequencies that are well outside the working band of the device itself. A well-known example is the signal from an AM transmitter that is heard while a gramophone record is being played, when the transmitter develops a field strength well above that to which the amplifier has been made immune. Since integrated circuits have small dimensions, they are much more sensitive to conducted rather than radiated disturbances. If these conducted interferences access an analog integrated circuit through outside paths, they will tend to prohibit the good working of this circuit in lots of ways, one of them for instance, by driving the biasing up and down, hereby heavily distorting the wanted signal(s) in the circuit. These amplitude variations may also cause severe DC shift errors on sensitive nodes in the respective circuit, due to the intrinsic non linear behavior of active components. This phenomenon will be called charge pumping.

Charge pumping can be a problem on a current mirror, which is widely used in analog circuits. The current mirror is a very useful structure to bias various circuits by copying and scaling currents. In its simplest form, the current mirror is composed of two transistors. A more detailed description can be found in K. R. Laker, W. M. C. Sansen, *Design of analog integrated circuits and systems*, Singapore: McGraw-Hill, 1994, chapter 4. The major strength of the current mirror is that it succeeds in yielding a global linear transfer function by using two non-linear components. This strength is also a weakness when, for instance, out of band EM disturbances are applied at its input node. The output current will then follow (almost) accordingly the input (depending on the magnitude and the frequency of the disturbance), thereby disturbing the circuits biased by this current mirror due to the large amplitude swings occurring on the output current. Placing a capacitor or a low-pass filter in the mirror node successfully filters the EMI signal, but causes charge pumping due to the non-linear Ids-Vgs relationship of a Metal Oxide Semiconductor Transistor (MOST).

Consider as an example a standard integrated current mirror, as shown in FIG. 10, comprising two NMOS transistors M1, M2 whose purpose is to provide an arbitrary DC bias current to an integrated circuit. An external DC current source (e.g. a resistor connected to the fixed supply voltage) determines the amount of input DC bias current. Let us use two identically sized transistors in this example for simplicity, to provide a unity current gain transfer function. Suppose an out-of-band EMI signal couples in on the external net (e.g. on the track connecting $I_{IN}$ and the IC pin 50): the total current through the first branch 51 of the mirror can then be modeled as the sum of the wanted DC current $I_{IN}$, and the unwanted (Norton equivalent) EMI AC current, called iemi. Externally, a decoupling capacitor can be placed to filter iemi: however, an application does not always allow the use such decoupling capacitor at an IC pin (e.g. if an inband wanted signal present is present): so for the sake of the argument, let us assume that since an EMI problem is present in this circuit, this decoupling capacitor is either absent, or simply ineffective at the respective EMI frequencies. Consequently, some internal protection and EMI filtering must be provided in the considered current mirror itself to eliminate the disturbing EMI frequencies.

Internally, a capacitor $C_t$ can be placed between the gate node and ground as shown in FIG. 11 and this reduces the bandwidth of the current mirror. A small signal analysis of a current mirror yields a transfer function which is characterized by a real pole at gm/Ct, with Ct being the total capacitance between the gate node and ground, and a right half plane zero due to the feed forward capacitance, which can usually be disregarded, as taught by E. Alarcón, E. Vidal, A. Poveda, "High-frequency response modeling of continuous-time current mirrors," *European Conference on Circuit Theory and Design* (ECCTD), pp. 204-209, Hungary, August 1997. The paper "New high-compliance CMOS current mirror with low harmonic distortion for high-frequency circuits," by R. A. H. Balmford, W. Redman-White, *Electronic Letters*, vol. 29, pp. 1738-1739, September 1993 teaches that at signal frequencies lower than the mirror pole frequency, the non linear output current can be approximated as:

$$I_{out} = I_{in} - C_t \frac{dV_g}{dt} \tag{14}$$

Below the pole frequency, almost no current flows through the capacitance Ct. Instead, all of the current flows through the drain of transistor M1, and previous equation can be rewritten as:

$$I_{out} = I_{in} - C_t \sqrt{\frac{1}{\frac{\mu C_{ox}}{2}\frac{W}{L}}} \frac{d}{dt}\left(\sqrt{I_{IN} + i_{emi}}\right) \tag{15}$$

This equation shows that the DC level of the output current is lower than the DC level of the input current, due to the loading of this capacitor Ct, and the distortion it equivalently causes. Indeed, because the interfering EMI signal is distorted by Ct, it will "pump" the DC value on this mirror node to a lower value than it should have if there was no distortion present. This phenomenon will be called after its origin: charge pumping. In this case, it is typically a barely noticeable effect due to the multiplication with Ct (usually very small) in the equation, as long as the EMI amplitude remains below the bias current. When the EMI amplitude becomes larger than the bias current, heavy non-linear distortions start to occur (e.g. clipping). This is highly undesirable, since it can substantially shorten the lifetime of the IC and cause latch up: indeed, if no extra precautions are taken, the undershoots will introduce substrate current flow via the parasitic bulk drain diode. The mirror pole is defined by gm/Ct, so typically a very large Ct must be used to place this pole below the lowest EMI frequencies. As an example, to obtain an arbitrary attenuation of −40 dB at 1 MHz, the mirror pole must be placed 2 decades lower, at 10 kHz. With gm equal to 135 μS (realistic value, refer to the example further down), the needed Ct is 2.1 nF, which is quite a high value in integrated circuits. This makes this solution rather impractical. Exploring this idea further however, one might consider placing a low-pass RC filter between the gates of the first and second transistors M1, M2 as shown in FIG. 12, with a cut-off frequency ωc that lies significantly lower than the frequency of the EMI disturbance ω, and a large value of R that does not load the input node (R>>1/gm1). Evaluating this circuit from a small signal point of view, there is no problem. However, doing the following, one is overlooking the fact that the voltage on the mirror node is not a linear function of the input current. This operation will filter EMI, but will equally cause charge pumping on the gate of M2, thereby lowering the DC output current value. This can be derived as follows. The interference $i_{EMI}$ is modeled as a sinusoidal wave:

$$i_{EMI}=\hat{i}\sin(\omega t) \tag{16}$$

Define the relationship between the amplitude of the EMI signal and the magnitude of the input bias current as the modulation index:

$$m=\frac{\hat{i}}{I_{IN}} \tag{17}$$

Considering that R>>1/gm1, the following equation holds:

$$V_{gs1}=V_t+\sqrt{\frac{1}{\frac{\mu C_{ox}}{2}\frac{W_1}{L_1}}}\sqrt{1+m\cdot\sin(\omega t)} \tag{18}$$

If the modulation index m is smaller than 1, Taylor expansion can be used. This yields:

$$V_{gs1}=V_t+\sqrt{\frac{1}{\frac{\mu C_{ox}}{2}\frac{W_1}{L_1}}}\left(1+\frac{1}{2}(m\cdot\sin(\omega t))-\frac{1}{8}(m\cdot\sin(\omega t))^2+\ldots\right) \tag{19}$$

Because ω>>ωc, Vgs2 can be approximated by the DC value of Vgs1 :

$$V_{gs2}\approx\langle V_{gs1}\rangle \tag{20}$$

-continued $$=V_{GS1}\square\frac{1}{T}\int_0^T V_{gs1}\cdot dt$$

$$=V_t+\sqrt{\frac{I_{In}}{\frac{\mu C_{ox}}{2}\frac{W_1}{L_1}}}\left(1-\frac{1}{16}m^2-\frac{15}{512}m^4-\ldots\right)$$

This last equation shows that extra terms in function of m are causing charge pumping on this node, this time not because of distortion due to loading, but because a linear operation has been performed on a non-linear signal. If m increases to higher values than 1, the disturbance amplitude becomes higher than the bias current introducing heavy non linear distortion with all its undesirable consequences as explained earlier in this section. At this point, Taylor expansion may not be used any more, and one must look at other means to expand this function (using for example Volterra power series): this involves however a lot of heavy calculations that do not contribute directly to more basic insight. The interesting conclusion drawn from previous basic calculations, is that charge pumping will occur, and that it will be worse for higher values of m. Observe that the charge pumping is independent of C and R (as long as ω>>ωc and that R>>1/gm1). FIG. 13 shows the dramatic effect of charge pumping on the output current of the circuit depicted in FIG. 12 over time, for an EMI signal with a frequency of 1 MHz and different amplitudes (varying from 0 to 30 μA). The bias DC current is 10 μA, and both transistors are equal in size (W/L=10μ/1μ; resulting gm=135 μS). The cutoff filter of the low-pass filter lies at 10 kHz (R=50 kΩ and C=320 pF) to provide an arbitrary attenuation of −40 dB at 1 MHz. This circuit was designed and simulated in a standard CMOS 0.35μ technology.

FIG. 14 shows an improved current mirror structure which is able to filter and to withstand EMI applied on its input, with a high degree of insensitivity against charge pumping. Observe that transistor M9 isolates the sensitive mirror node 43 from the drain of M7. Transistor M8 provides a low impedance current path to ground. If M9 is equally sized to M8, then Vgs1=Vgs2=Vin/2. An important point of this circuit is that transistors M9 and M8 keep the sensitive mirror node 43 at a fixed DC level by means of negative feedback. Indeed, if the DC level of Vgs1 rises, then the DC component of the drain current of M9 will drop while the DC component of the drain current of M8 rises, forcing M8 to discharge the capacitance on that node until the equilibrium is restored. The same principle holds if <Vgs1> goes down. Adding capacitors C1 and C2 provides the means to integrate a $2^{nd}$ order low-pass filtering in this circuit.

It will now be proven that charge pumping is reduced: because the main interest lies in gaining an understanding of the circuit. Some sound approximations will be made in the same way as in the previous paragraph. First of all, note that Vgs1=Vgs4, so the current through the drain of transistor M7 is equal to the output current Iout. Disregarding the parasitic capacitances of the transistors, and performing a small signal analysis, the current transfer function between input and output is found to be equal to:

$$H(s)=\frac{i_{out}(s)}{i_{in}(s)}=\frac{gm10/gm7}{\left(\frac{C1\cdot C2}{gm7\cdot gm9}\right)s^2+\left(\frac{C1(gm8+gm9)}{gm7\cdot gm9}\right)s+1} \tag{21}$$

Consider again the same EMI disturbance (16). The drain current of M7 is then equal to:

$$I_{out} = I_{d1} = I_{IN} + \frac{m}{A_c(\omega)} \cdot I_{IN} \sin(\omega t) \tag{22}$$

where Ac(ω) is the attenuation presented by the current mirror at the specified frequency ω. For small disturbance amplitudes, this value is equal to |H(jω)|. For higher disturbance amplitudes, this value will diverge from |H(jω)|, but again, the important thing to remember is that there is an attenuation, reducing Iout and similarly the charge pumping on the mirror node. Using the Taylor expansion (m/Ac(ω)<1) to find the DC value on the mirror node yields:

$$\begin{aligned}\langle V_{gs1}\rangle &= V_{GS1} \frac{1}{T}\int_0^T V_{gs1} \cdot dt \\ &= V_t + \sqrt{\frac{I_{IN}}{\frac{\mu C_{ox}}{2}\frac{W_1}{L_1}}}\left(1 - \frac{1}{16}\left(\frac{m}{A_c(\omega)}\right)^2 - \frac{15}{512}\left(\frac{m}{A_c(\omega)}\right)^4 - \dots\right)\end{aligned} \tag{23}$$

Comparing this result to (20), it can be seen that the charge pumping term is much smaller due to the Ac(ω) term. For EMI frequencies lying above the unity gain frequency of the feedback transistors, the remaining EMI will still be filtered by C1, reducing the filter order from a 2nd to a 1st order.

Figure 15:
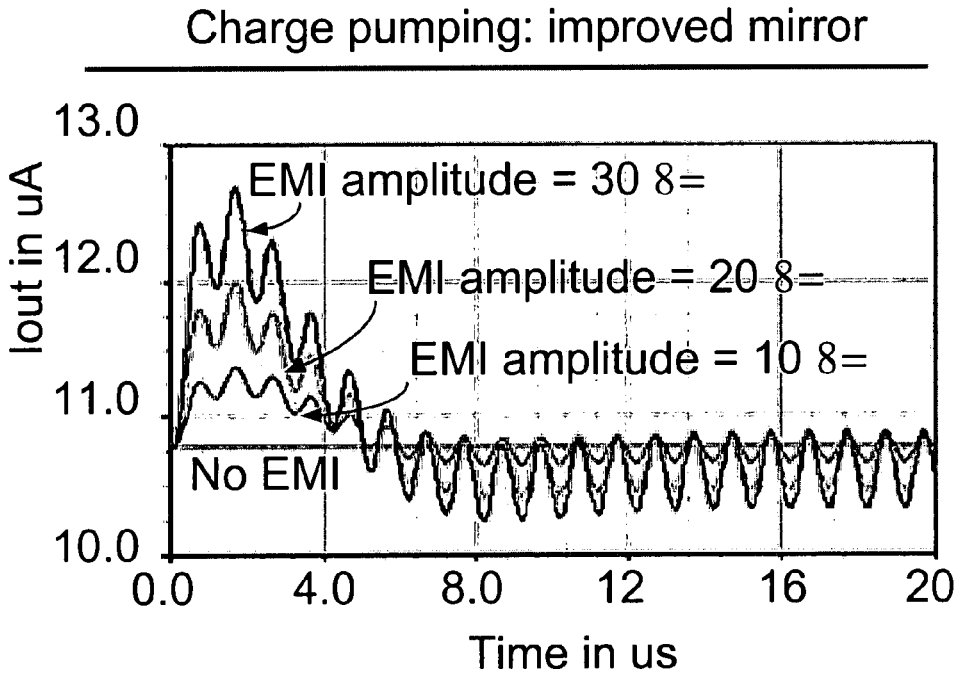
FIG. 15 shows the effect of charge pumping on the output current of the improved current mirror of FIG. 14.

As an example, FIG. 15 shows the effect of charge pumping on the output current of the improved current mirror, using the same EMI disturbance and bias current as in the previous example of the standard current mirror with low-pass RC filter. The size of M7 has been chosen equal to the size of M10 (W7/L7=W10/L10=10 u/1 u; gm7=gm10=135 uS) and in the same way M9 has been chosen equal to M8 (W9/L9=W8/L8=5 u/1 u; gm9=gm8=62 uS). Capacitors C1 and C2 determine the location of the two poles: these were selected according to a Butterworth filter synthesis (C1=158 pF, C2=140 pF). As a reference as well as a point of comparison, the same arbitrary attenuation of −40 dB at 1 MHz has been chosen correspondingly to the previous example. FIG. 15 shows that the EMI disturbance is strongly attenuated, and that after a brief settling, the DC component of Iout is almost identical to the expected value of 10 μA, if no disturbance were present (almost, because as discussed in (23), the charge pumping term is strongly attenuated but nevertheless still present, this is slightly visible in FIG. 15). Compared with the transient result of the current mirror with a low-pass filter between its gates (FIG. 13), this is a considerable improvement.

Figure 16:
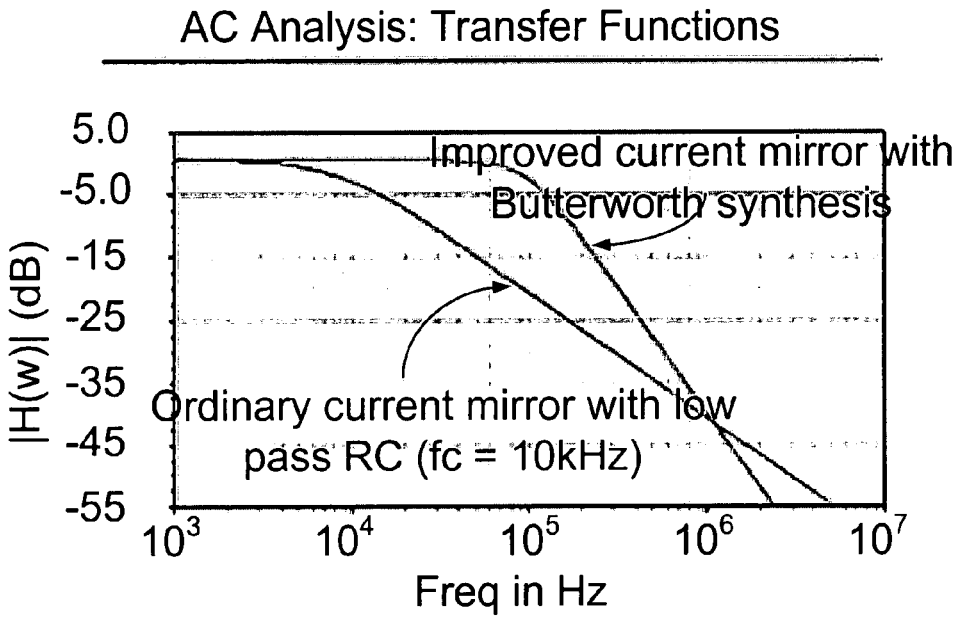
FIG. 16 shows the small signal transfer function of the improved current mirror of FIG. 14.

FIG. 16 is a comparative AC plot showing the transfer function of the improved current mirror, together with the transfer function of the ordinary current mirror that has been previously simulated. Both circuits were dimensioned to provide an attenuation of −40 dB at 1 MHz.

Figure 17:
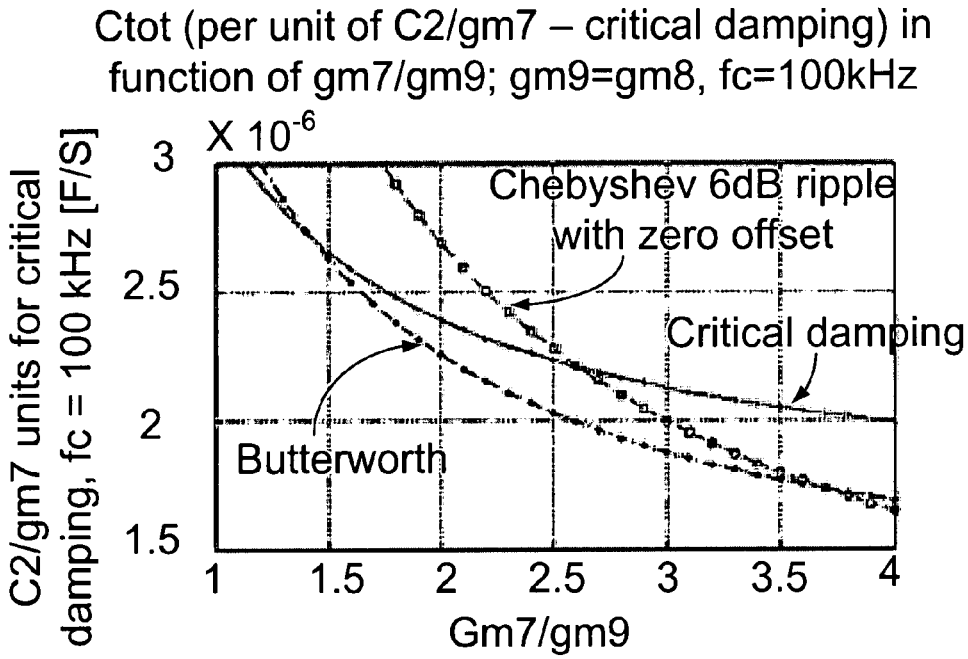
FIG. 17 shows the filter synthesis yielding the smallest total capacitance for a cut off frequency at 100 kHz and for a given gm1/gm2 ratio; and, FIG. 18 shows the total needed capacitance in function of the cutoff frequency, for Butterworth synthesis.
Figure 18:
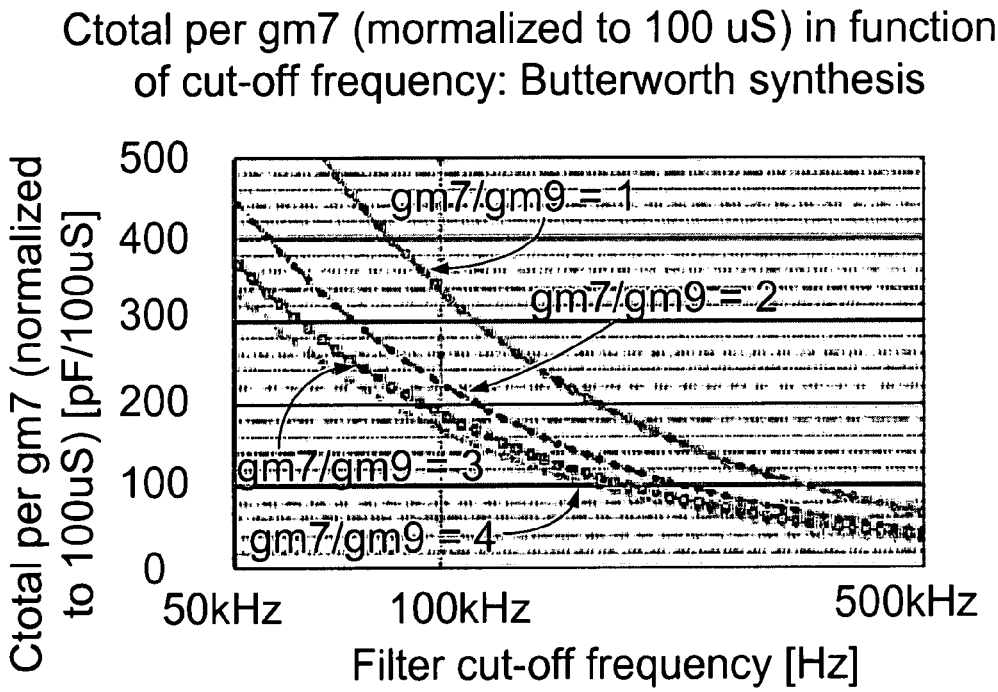

Capacitance is an expensive element to use in integrated circuits, so it is better to use this resource as economically as possible. Keeping the same cutoff frequency while minimizing the sum of C1 and C2 depends on the filter synthesis used. FIG. 17 shows that the filter synthesis yielding the minimal total capacitance for a fixed cut off frequency at 100 kHz depends on the ratio of gm1/gm2. Remember that M9 and M8 were chosen equal in size, and since their drain biasing currents are equal, they have the same transconductance, so gm9=gm8. The Y axis of this plot mentions the total needed capacitance (C1+C2) expressed as units of C2 per gm1 in the critical damping case, while the X axis reports the ratio of gm1/gm2. This allows a relative comparison, independent of the absolute values of gm7 and gm10. Three synthesis methods have been compared and plotted, namely: critical damping, Butterworth and Chebyshev. FIG. 17 shows these three curves, associated to the total relative needed capacitance to realize this respective filter synthesis for a cut off frequency at 100 kHz. The conclusion of this plot is very straightforward: for gm7/gm9<1.4, critical damping yields the smallest total capacitance. When gm7/gm9>3.7, Chebyshev synthesis gives the optimal result. In between these two values, Butterworth synthesis requires the smallest total capacitance. A different insight is provided in FIG. 18, namely a plot of the total needed capacitance in function of the cutoff frequency, for Butterworth synthesis. Here, the total needed capacitance is expressed relatively per unit of gm1, which is normalized to 100 μS. Note from this plot that there is no point in increasing the ratio gm7/gm9 above 3, since the resulting reduction of $C_{total}$ becomes negligible. A similar trend has been observed for critical damping and Chebyshev synthesis.

The invention is not limited to the embodiments described herein, which may be modified or varied without departing from the scope of the invention.

The invention claimed is:

1. A current regulator circuit comprising:

a first circuit node (32) which is operable to receive an external input voltage;

a transistor (M1) having an input, a first leg and a second leg, the first leg of the transistor being isolated from the first circuit node (32);

an amplifier (10) having an output connected to the input of the transistor, a first amplifier input for receiving a reference voltage ($V_{REF}$) and a second amplifier input connected to the first circuit node (32);

a low-pass filter (33) connected between the output of the amplifier and the first circuit node (32);

a current mirror (36) connected in series with the second leg of the transistor (M1) and having a first branch (38) for providing a regulated output current and a second branch (37) which connects to the first circuit node (32), wherein the first branch (38) is directly or indirectly coupled to an output stage (40), which comprises a further current mirror, wherein the further current mirror is an EMI-filtering current mirror.

2. A current regulator circuit according to claim 1 wherein the low-pass filter (33) is an integrator comprising a resistor (Ri) connected between the first circuit node (32) and the second input of the amplifier (10) and a capacitor (Ci) connected between the output of the amplifier (10) and the second input of the amplifier (10).

3. A current regulator circuit according to claim 1 wherein the low-pass filter (33) has a bandwidth such that the gain-bandwidth product (GBW) of the amplifier is lower than a predetermined EMI frequency.

4. A current regulator according to claim 3, wherein the predetermined EMI frequency is the lowest EMI frequency to be filtered.

5. A current regulator circuit according to claim 3 wherein the low-pass filter (33) has a bandwidth such that the gain-bandwidth product (GBW) of the amplifier is at least one order of magnitude lower than the lowest EMI frequency to be filtered.

6. A current regulator circuit according to claim 5 wherein the low-pass filter (33) has a bandwidth such that the gain-bandwidth product (GBW) of the amplifier is at least two orders of magnitude lower than the lowest EMI frequency to be filtered.

7. A current regulator circuit according to claim 1 wherein the first leg of the transistor (M1) connects to a supply rail via a resistor (34) which is operable to self-bias the transistor (M1).

8. A current regulator circuit according to claim 1, wherein the EMI filtering current mirror comprises:

a second transistor (M7) and a third transistor (M10) whose gates are connected together at a mirror node (43), the second transistor (M7) having an input branch (41) to receive current and the third transistor (M10) having an output branch (42) to mirror the received current as an output current ($I_{ref}$);

a fourth transistor (M8) connected between the mirror node (43) and a supply rail (Vcc); and, a fifth transistor (M9) connected between the mirror node (43) and another supply rail and having an input connected to the input branch.

9. A current regulator circuit according to claim 8 further comprising a first capacitor connected between the input branch and a supply rail (Vcc) and a second capacitor connected between the mirror node (43) and the supply rail (Vcc).

10. A current regulator circuit comprising:

a first circuit node which is operable to receive an external input voltage;

a transistor having an input, a first leg and a second leg, the first leg of the transistor being connected to the first circuit node;

an amplifier (10) having an output connected to the input of the transistor, a first amplifier input for receiving a reference voltage ($V_{REF}$) and a second amplifier input connected to the first circuit node;

a low-pass filter connected between the output of the amplifier and the first circuit node; and, a current mirror connected in series with the second leg of the transistor, wherein the current mirror comprises a second transistor and a third transistor whose gates are connected together at a mirror node, the third transistor having an input branch connected in series with the second leg of the transistor to receive current and the third transistor having an output branch to mirror the received current as an output current ($I_{ref}$);

a fourth transistor connected between the mirror node and a supply rail (Vcc); and, a fifth transistor connected between the mirror node and another supply rail and having an input connected to the input branch.

11. A current regulator circuit according to claim 10 further comprising a first capacitor connected between the input branch and a supply rail and a second capacitor connected between the mirror node and the supply rail.

12. A method of generating a regulated current using the current regulator circuit according to claim 1.

13. A method of generating a regulated current using the current regulator circuit according to claim 8.

14. A method of generating a regulated current using the current regulator circuit according to claim 10.

15. A current mirror circuit comprising:

a first transistor (M7) and a second transistor (M10) whose gates are connected together at a mirror node (43), the first transistor (M7) having an input branch (41) to receive current and the second transistor (M10) having an output branch (42) to mirror the received current as an output current ($I_{ref}$);

a third transistor (M8) connected between the mirror node (43) and a supply rail (Vcc); and, a fourth transistor (M9) connected between the mirror node (43) and another supply rail and having an input connected to the input branch.

16. A current mirror circuit according to claim 15 further comprising a first capacitor connected between the input branch and a supply rail (Vcc) and a second capacitor connected between the mirror node (43) and the supply rail (Vcc).

17. A current regulator circuit according to claim 1 implemented in the form of an integrated circuit, where the first circuit node connects to an external pin of the integrated circuit.

18. A current regulator circuit according to claim 8 implemented in the form of an integrated circuit, where the first circuit node connects to an external pin of the integrated circuit.

19. A current regulator circuit according to claim 10 implemented in the form of an integrated circuit, where the first circuit node connects to an external pin of the integrated circuit.

20. A current regulator circuit according to claim 15 implemented in the form of an integrated circuit, where the first circuit node connects to an external pin of the integrated circuit.

* * * * *